United States Patent [19]

Fischer

[11] Patent Number: 4,512,506

[45] Date of Patent: Apr. 23, 1985

[54] SYSTEM FOR THE SUPPLY OF STAPLE WIRE TO A STAPLER

[75] Inventor: Emil Fischer, Ludwigshafen-Oggersheim, Fed. Rep. of Germany

[73] Assignee: Albert-Frankenthal AG, Frankenthal, Fed. Rep. of Germany

[21] Appl. No.: 470,786

[22] Filed: Mar. 1, 1983

[30] Foreign Application Priority Data

Mar. 19, 1982 [DE] Fed. Rep. of Germany ..... 3210014

[51] Int. Cl.[3] ..... B27F 7/21

[52] U.S. Cl. ..... 227/5; 227/78; 227/81

[58] Field of Search ..... 227/5, 78, 81, 82, 83, 227/84, 85, 86, 87, 88, 89, 90, 91

[56] References Cited

U.S. PATENT DOCUMENTS 4,318,555 3/1982 Adamski et al. ..... 227/78

FOREIGN PATENT DOCUMENTS 1074198 6/1967 United Kingdom ..... 227/81

*Primary Examiner*—Paul A. Bell

*Attorney, Agent, or Firm*—Collard, Roe & Galgano

[57] ABSTRACT

In a staple wire supply system for use in connection with printing machinery or the like and of the sort having a fixed wire guide pipe past whose outlet end a knife is moved for cutting the wire down to the size needed for stapling, the time needed for the operation of changing over to a new reel of wire when one reel has run out may be greatly cut down by so designing the system that two reels may be supported thereon at a time and having a unit for running one wire from one such reel to the guide pipe and guiding the other wire into a ready or waiting position. Between this unit and the guide pipe there are two wire driving parts, such as pinch rollers acting on opposite sides of a capstan, which may be changed over in direction and may be used for moving wire from the two reels in oposite directions at the time of reel changing.

18 Claims, 2 Drawing Figures

SYSTEM FOR THE SUPPLY OF STAPLE WIRE TO A STAPLER

BACKGROUND OF THE INVENTION

The present invention is with respect to a unit for the supply of staple wire to a stapler, and more specially to a stapler joined to a folder placed on the outlet side of a web feed printing press, having a stationary cutting wire guide pipe that is used with a moving knife in cutting the wire and which is supplied with the wire from a supply reel of such wire by way of a wire feeding unit.

DISCUSSION OF THE PRIOR ART

In known units of this sort there has so far only been one wire supply roll or reel and when the wire thereon has been used up, it is then necessary for the piece of wire stretching as far as the feed unit to be pulled out and for the empty reel core to be taken off. After this has been done, it is then necessary for a new, full reel to be put in place and the outer end of the wire therefrom to be threaded into the guide channel. This reel changing operation, that has to be undertaken in the middle of production, takes a long time. Furthermore the products run off the machine in this time will not have any staples as otherwise made by the stapler and such products will be only waste. In fact, in the case of high speed machines there is likely to be a heavy loss in production because of such waste and the profit made on the plant will be seriously cut down.

SHORT OUTLINE OF THE INVENTION

Taking this stage of development of the art as a starting point, one purpose of the present invention is that of overcoming the shortcomings of known machines and of designing a unit of the sort noted which makes possible a more or less "flying" change of the stapling wire reels so that there is a great decrease in the amount of waste produced when a change is made.

For effecting this purpose and further purposes in keeping with the present invention the unit is designed for taking up two reels of staple wire, from which the moving wire supplied to the cutting pipe or staple wire being kept in a waiting position may be unreeled, and which has placed before it in the direction of wire motion a change unit, that has two driving parts that may be put into operation in opposite directions, each one of such driving parts taking up one of the two staple wires from the two reels and being able to be used for driving the one or the other of the two said wires for changing over the reels and being able to be reversed.

On using the changing unit it is now possible for the short piece of wire at the end of a reel, and which may not be processed, to be pulled back from the unit and at the same time for the wire from the new reel to be moved forwards into the unit. This operation may be undertaken in a very short time. The number of products without any staples because the wire has run out and the reel changing operation is slow, is for this reason greatly limited and this is a rewarding, useful effect of the invention. After the reels have been changed over, the empty reel core may be taken off and its place taken by a new unused one. The wire will be unrolled from it somewhat and put in a ready or waiting position for the next change-over of the reels. The time necessary to do this does not have any undesired effect on production. Because of the change in the direction of driving the reel changing system the system will automatically be placed in the right starting position for a change of reels. Even with the decrease in the time needed for changing reels it is nevertheless possible to make certain that the end piece of the used-up wire may be taken out of the guide channel and does not have to be pushed out through the cutting pipe by pushing in the end of the new wire, this making the unit very safe and trouble-free in operation. The useful effects produced by the invention are for this reason to be seen, more specially, in the great economies possible.

As part of a further useful development of the invention the driving motion of the driving system of the changing unit may best be so limited that the feed distance to be produced in each case is equal to at least the distance from the front end of the staple wire in a waiting position to the nip or wire gripping part of the feed unit. These measures in the design of the invention are responsible for the use thereof being very simple inasfar as the staple wire in the waiting position is safely gripped and taken up by the feed unit and for this reason is transported completely regularly and under full control. At the same time the end piece of wire from the used up reel, that so far has been gripped by the feed unit is pulled back by the same distance and for this reason there is certainly no danger of a smash up between the two pieces of wire.

As part of a specially simple form of the staple wire change-over system there is a capstan so placed that the two staple wires are guided onto it at a tangent and so designed that it may be turned in the one or the other direction, the capstan having two pinch rollers for pressing the staple wires against two points on it, the capstan being placed between the two wires. The capstan, that may be reversed for each new change-over of the staple wire from a new wire reel, makes possible two opposite directions of wire transport on the direction of turning of the capstan being changed over. The end position of the capstan at the end of each reel change-over operation is for this reason at the same time the starting position for the next reel changing operation. There is the useful effect that the change-over system does not have to have any adjustment made to it between one reel changing operation and the next one thereafter.

As a further useful development of the present invention the feed unit and the driving parts of the change-over system may be controlled by way of their own separate servo drives, that for their part are under the control of a common controller, so that the feed unit and the driving parts may be put into and out of operation in turn, that is to say when the one is working the other is still and the other way around. This further outgrowth of the general teachings of the present invention makes control of the system generally simpler so that operation is quicker. At the same time the system is more readily automated with respect to the complete reel changing operation.

As part of a further useful outgrowth of the invention there is a wire brake at each wire channel running through the change-over system. This is to make it impossible for the wire in the waiting position to be moved out of position or transported simply by chance effects such as vibration of the system and it is in fact kept locked in the desired waiting position.

Further useful developments of the invention and preferred measures thereof will be seen from the account now to be given of one working example using the figures.

LIST OF VIEWS OF THE FIGURES

DETAILED ACCOUNT OF WORKING EXAMPLE OF THE INVENTION

Figures 1, 2:
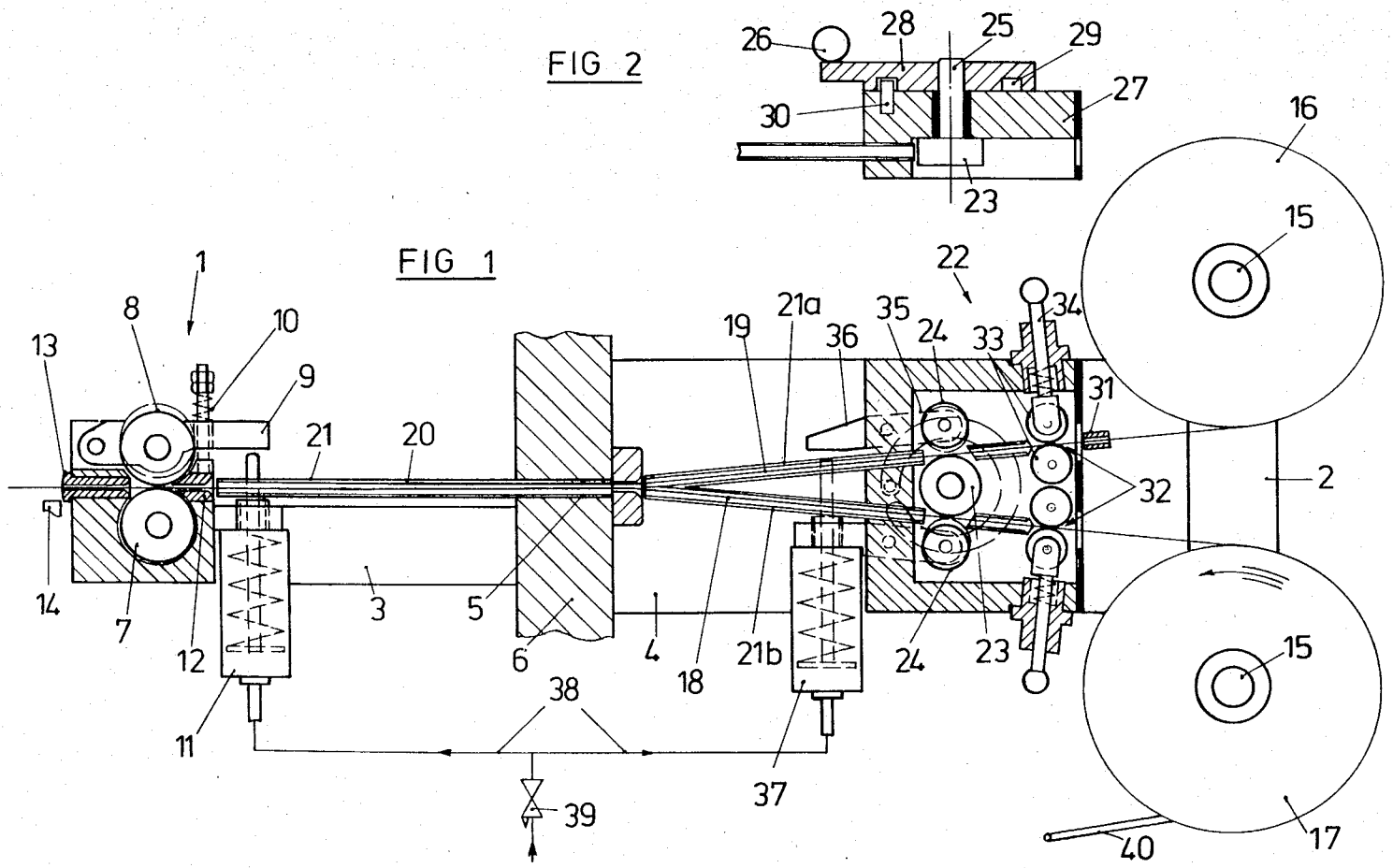
FIG. 1 is a diagrammatic view and part section of a wire guide and supply system used with a stapler.
FIG. 2 is a view of one example for a simple drive for the capstan of the change-over system in keeping with FIG. 1.

The general design and workings of staplers for stapling folded products made up of separate sheets using wire staples are known to those versed in the art so that no full account thereof is needed here. At each stapling station such a stapler gets wire from a supply reel, that is to say, the wire is pulled off from the reel as needed and transported to the stapler. The wire supply system to be seen in FIG. 1 is made up of a feed unit 1 and a reel support 2. These two assemblies are themselves supported on parts 3 and 4 on the inside and on the outside of a side wall 6 of the stapler, the wall 6 having a wire opening 5 that is aligned therewith on single axis. The feed unit 1 has two feed rollers 7 and 8 between which the wire is run before it is made into staples. In the present working example the one feed roller 8 is supported on a bearing on a lever 9, that is pressed downwards by an adjustable loading spring 10 for gripping the wire against the other feed roller 7. The feed roller 8 may be lifted clear of the lower roller 7 (whose axis is stationary) against the effect of the spring 10 by way of a servo 11 in the form of a fluid power actuator. By putting the servo 11 into operation and taking it out of operation the supply of wire may be cut off without the drive for the feed rollers 7 and 8 having to be stopped. In the nip between the two rollers 7 and 8 there is an inlet guide pipe 12 so placed and designed that the start or front end of a length of wire to be supplied between the feed rollers 7 and 8 may in fact be run in between them under full control so that one may be certain that such wire is in fact transported by the feed rollers. On the side of the rollers 7 and 8 opposite to the inlet guide pipe 12 there is a cutting pipe 13 or nipple, whose left hand end has the function of a stationary knife for use with a moving knife 14, that is run up and down across such face cutting the wire to lengths that are dependent on the timing of the knife 14. The lengths are equal to the size of the staples.

The reel support 2 or chair has reel support pins 15 for two reels 16 and 17 of wire, that is to say cores or bobbins with wire wound thereon. The cores may be in the form of simple resin bobbins whose inner tubes are able to be freely turned on the supporting pins 15. Wire is first taken from one reel and then from the other so that while one reel is being used up, another reel may be put in place and readied. In the condition to be seen in FIG. 1, the reel 17 is supplying the wire 18 that for this reason is being gripped between the feed rollers 7 and 8 of the feed unit 1. The wire 19 taken from the other reel 16 is fixed in position so that its front end 20 or start is in a waiting or ready position short of the feed unit 1. Once the one reel 17 has given up nearly all its wire, that is to say when the wire thereon is at the point of running out, the wire feed is stopped, the last length of wire that is still being gripped by the feed unit 1 is pulled out backwards from the feed unit and at the same time the start 20 of the wire, unreeled from the reel 16, is run into the feed unit 1. At this stage, it is now possible for the feed unit 1 to be started again by putting the rollers 7 and 8 into operation so that wire is now taken from the reel 16. The wire now supplied to the feed unit 1 goes through a wire guide 21 that is best in the form of a tube or pipe stretching from the reel support 2 and the feed unit 1. The wire guide 21 is forked or branched to the right of the stapler side wall 6 (outside it) as two branches 21*a* and 21*b* running towards the two reels 16 and 17.

For speeding up reel change-over there is a change-over unit 22, that in the present case has the branches 21*a* and 21*b* running through it, and which is united with the reel support 2. The unit 22 is in the present working example made up of a capstan 23 supported for turning about a stationary axis and two diametrically opposite (with respect to a diameter of the capstan 23, that is) pinch rollers 24 for acting on the outer face of the capstan 23 and gripping the wire thereagainst with the wire at a tangent to the capstan so that the wire (18 or 19) may be pushed along because the capstan 23 is turning. In fact, for a given direction of turning of the capstan 23, one wire will be moved in one direction and the other wire in the opposite direction, the direction of turning being controlling as to which wire is moved forwards into a waiting position and which is pulled backwards for taking wire from the new, full reel and pushing wire back towards the used reel. The direction of the capstan 23 is changed over each time reels are exchanged as a new full reel is placed on one of the pins 15 and then, the next time, on the other pin while the used up reel is in each case on the other pin 15.

As the reader will see from FIG. 2, the capstan 23 is joined up by a shaft 25 with a handwheel having a handle 26 and furthermore a round plate 28 resting against the housing 27 of the change-over unit. This plate 28 has a curved groove 29 running around its axis for a limited angle and having a pin 30 (fixed to the housing) taken up in it. The capstan 23 may for this reason only be turned till one or the other end of the groove 29 has run up against the pin 30 acting as a fixed stop. And then it will not be possible for the capstan to go on being turned in the same direction and it may only be turned back in the opposite direction. This design in fact makes certain that the capstan 23 may only be turned to a limited degree in the one direction. The length or angle of the curved, coaxial groove 29 is in fact controlling for the degree of turning of the said capstan 23 and the wire 18 or 19, whichever may be the case, is only moved to a limited, regular degree.

The capstan 23 is designed with such a diameter that the angle of turning, as dependent on the length of the curved groove 29, is responsible for such a degree of transport of the wire that the start 20 of the wire 19 in the waiting or ready position may be certainly gripped by the feed rollers 7 and 8 and at the same time one may be certain of clearing the rest 18 of the used wire completely from the cutting pipe 13 and inlet guide 12. This is made possible inasfar as the distance between the ends, furthest from each other, is somewhat smaller than the distance between the front end 20 of the piece of wire 19 in the ready position and the nip of the feed rollers 7 and 8, this distance in turn being dependent on the angle of turning of the capstan 23 and its diameter, in the change-over unit 22. To make certain that the ready position of the front end 20 of the wire is the same every time and completely regular, the length which the wire is to be moved in at the wire guide 21 is measured and "memorized" on the wire (in the present case the wire 19) by fixing a gripper 31 on the wire. The wire may then simply be pushed into the wire guide 21 as far as the gripper will let it, that is to say when the gripper has come up against a stop, in the present case the housing of the change-over unit 22. It would however be possible for the wire guide to have a window or for all of it to be made of glass-clear material. For stopping any uncontrolled motion of the wire (in the present case the wire 19) waiting at the ready because of vibrations or the like, each wire guide branch 21*a* and 22*b* has a brake 32 and in the present case each such brake is made up of two brake rollers 33 that are braked and not turned readily. They are forced onto the wire running between them by a loading spring in each case. It is best if the design is such that one roller of each two rollers may be pulled back clear of the wire so as to make it simpler for the end of a new supply of wire to be threaded into the desired position. In the system the moving roller in each case is simply fixed to one end of a sliding rod 34.

The pinch rollers 24 acting against the capstan 23 and bearinged on levers 35 are designed stretching out to the left past their turnpins as arms 36. For loading the pinch rollers 24 against their capstan 23 their arms 36 are pressed in an opening direction, this being done by a servo 37, fixed on one of the arms 36, in the form of a simple fluid power actuator. On working the actuator or servo 37 its piston rod is moved out aginst the other arm 36. The fluid supply lines 38 running to the servos 11 and 37 are turned on and off using a common control valve 39. The position of this control valve 39 may be so changed that, at the same time, the feed roller 8 is lifted clear of the other feed roller 7 so that the feed unit 1 is turned off and the pinch rollers 24 are forced against the capstan 23 so that on turning the driving capstan the one wire may be moved forwards and the other wire may be pulled back as desired. The decrease in diameter of the reel (in FIG. 1, the reel 17) from which wire is being taken is monitored by a sensing system, as for example a photoelectric system or the like. In the present example of the invention, however, a simple mechanical feeler 40 is used that gives a signal once the wire is running out and the control valve 39 is worked thereby. When this takes place, the further feed of the wire 18 run off the reel 17 is stopped and at the same time the wires 18 and 19 are pressed against the driving capstan 23. Then the capstan is turned counter-clockwise so that the wire 18 is pulled out backwards from the unit 1 and the other wire 19 is moved so far forwards that its front end 20 is gripped in the nip of the feed rollers 7 and 8. Next the control valve 39 is moved in the opposite direction and for this reason the wires 18 and 19 are let go of in the change-over unit 22 and the wire 19, that has been run up to the feed unit 1, is transported. The short length of wire still coming from the reel 17 may then be pulled right out of the wire guide 21. And the empty reel (that is to say reel core or bobbin) 17 may be taken down and its place taken by a full reel. The end of the wire on this new reel 17 is threaded inwards as far as the ready position even while the apparatus is still running. The next time the reels have to be changed over it will then be this wire that is moved into the feed unit 1 and the other wire (19) pulled back, for which purpose the capstan 23 is turned clockwise. The presence of the curved groove 29 makes it simpler to see which direction the capstan has to be turned in.

In the present form of the invention taken as a working example the control valve 39 is designed so that it may be worked by hand. However for automatic operation of reel change-over the valve 39 might be a solenoid valve that would be put into operation together with a driving motor for the capstan 23 by way of the monitoring system 40. The drive motor for the capstan would then simply be a synchronous motor which would be able to be reversed. For limiting the driving motion of the driving capstan 23 a limit switch may be present that is worked thereby, such limit switch turning off the driving motor and at the same time putting the control valve 39 out of operation.

While it is true that the account so far has been limited to a more specially preferred form of the invention, this is not to have the effect of limiting the idea, that will be clear to the mind of one trained in the art, of the invention. In fact, a large number of changes may be made within the framework of this general idea, and to take one example, the middle capstan 23 and the pinch rollers 24 used therewith, forming together feed systems running in opposite directions, might have their place taken by a two-armed lever, whose two arms would have wire grippers and which would be rocked first in one and then in the opposite direction.

I claim:

1. An apparatus for the supply of stapling wire to a stapler, comprising a frame, a stationary wire guide pipe for feeding wire through an outlet end thereof with a sharp cutting edge, a moving knife, means for moving said knife past said pipe outlet and cutting said wire thereat, a support for two reels of stapling wire, a wire feed unit for transporting said wire from said reel to said pipe, said reel support being designed for supporting two said reels in working positions thereof, means forming a ready station for supporting a length or wire from one of the reels in which said wire is kept in a ready or waiting position some distance short of the feed unit, and for guiding wire from the other of said reels to said feed unit, a change-over unit placed between the reels and the feed unit, said change-over unit having two wire driving parts designed to be moved in opposite directions and having one of said wires from said reels running through them, said change-over unit's wire driving parts being able to take effect on the wire going therethrough, and means for changing over the direction of motion of the two wire driving parts when the reels are to be changed over and wire supplied to the guide pipe in place of wire from the other reel.

2. The apparatus as claimed in claim 1 further comprising means for limiting motion of the wire driving parts.

3. The apparatus as claimed in claim 2 wherein said means for limiting motion of the wire driving parts permits a driving motion of the wire driving parts at least equal to a feed path running from the position of the said wire in the ready position to the position to which said wire has to be moved towards said guide pipe for it to be acted upon by said wire feed unit.

4. The apparatus as claimed in claim 3 wherein the means for limiting motion of the wire driving parts permits a driving motion of the wire driving parts so that said feed path running from the position of the said wire in said ready position and the position to which said wire has to be moved towards said guide pipe is greater than the distance to be moved for removal of the wire in said feed unit.

5. The apparatus as claimed in claim 1 comprising, as part of said change-over unit, a wire guide with two branches coming together at a common point and a capstan with two pinch rollers for gripping wire against the capstan, the said capstan being placed between the two wires from the two reels, and means for turning the capstan in two directions.

6. The apparatus as claimed in claim 5 comprising a system for limiting turning of the capstan to a given angle, this said system being made up of a stop and a part with a curved groove such that relative turning motion between the part with the groove and the stop is responsible for limiting turning of the said capstan.

7. The apparatus as claimed in claim 6 wherein said part with said curved groove is a round plate keyed to said capstan, said pin being fixed to said frame.

8. The apparatus as claimed in claim 7 comprising a crank handle for turning said capstan.

9. The apparatus as claimed in claim 5 having levers for supporting said pinch rollers and a servo for operation of the levers at the same time.

10. An apparatus as claimed in claim 1 having, as parts of said driving parts of the said change-over unit and said feed unit, servos and a common controller for same so that said servos may be put into and out of operation in turn.

11. The apparatus as claimed in claim 1 comprising in said wire feed unit two feed rollers, a lever supporting one of said feed rollers and a servo for operation of at least one of said feed rollers.

12. The apparatus as claimed in claim 11 wherein said servo is the form of a fluid power actuator cylinder.

13. The apparatus as claimed in claim 1 comprising a reversible motor for driving said change-over unit and a monitoring system for operation of said reversible motor, said monitoring system having a means sensing the amount of wire on the two reels and putting said reversible motor into operation one sensing a condition in which wire on one of the said reels is on the point of running out of wire.

14. The apparatus as claimed in claim 13 having a limit switch for limiting motion of said reversible motor and switching over said motor to the opposite direction of turning, said apparatus further having a controller that is put out of operation by said motion limiting switch.

15. The apparatus as claimed in claim 1 having a branching wire guide with two wire guide branches, each such branch having a wire brake.

16. The apparatus as claimed in claim 15 wherein said brakes have two rollers that are pressed together onto said wire.

17. The apparatus as claimed in claim 1 having a gripping marker that may be fixed on the wire and undone therefrom for the purposes of limiting motion of the wire into the said ready or waiting position.

18. The apparatus as claimed in claim 1 having a tube-like wire guide for the wires, said guide branching like a letter Y towards said reel supports.

* * * * *